United States Patent [19]

Wedzik

[11] 4,285,442

[45] Aug. 25, 1981

[54] DRINKING CUP LID

[76] Inventor: Theresa M. Wedzik, 210 Hillcrest Ave., Erie, Pa. 16509

[21] Appl. No.: 155,842

[22] Filed: Jun. 2, 1980

Related U.S. Application Data

[63] Continuation of Ser. No. 35,629, May 3, 1978, abandoned.

[51] Int. Cl.[3] ..... B65D 41/48; B65D 41/37

[52] U.S. Cl. ..... 220/270; 220/90.4; 229/7 R; 229/43

[58] Field of Search ..... 220/90.2, 90.4, 266, 220/270; 229/7 R, 7 S, 43

[56] References Cited

U.S. PATENT DOCUMENTS

| | | | |
|---|---|---|---|
| 3,524,566 | 8/1970 | Parks | 229/7 S |
| 3,800,999 | 4/1974 | Serritella | 229/7 R |
| 3,977,562 | 8/1976 | Wedzik | 220/266 |
| 4,056,210 | 11/1977 | Boyle | 220/90.4 |

*Primary Examiner*—George E. Lowrance

[57] ABSTRACT

A disposable lid for a disposable paper cup. The lid has a groove on its under side to be fitted over the rim of the cup and the lid additionally includes a pair of radially extending scored lines converging toward each other which terminate in lines cut completely through the lid that intersect at a point to provide for pushing the lid material inward to admit a drinking straw. A pie-shaped piece of lid material enclosed by the scored lines can be torn and lifted out to provide an opening from which a person can drink the contents of the cup.

1 Claim, 13 Drawing Figures

DRINKING CUP LID

This is a continuation of application Ser. No. 035,629 filed May 3, 1978, now abandoned.

GENERAL DESCRIPTION OF THE INVENTION

The invention recites generally a lid for a disposable drinking cup and more particular a disposable lid for closing disposable drinking cups providing an opening for a drinking straw, an opening for drinking from said cup, and pressure vents.

OBJECTS OF THE INVENTION

It is an object of the invention to provide a drinking cup lid that is scored so as to form a liftable tab in order that the beverage may be drunk from a cup without the removal of the entire lid and an extension of the liftable tab that is fully cut through, allowing a drinking straw to be inserted. The lid as well as the removable tab is held in place by a groove that fits down over the rim of the cup so that the tab when removed can be replaced to maintain the temperature of the material in the cup. The openings also vent air or gases from the inside of the cup and provide for easy transportation and for a simple manufacturing process.

Another object of the invention is to provide a drinking cup lid with an opening for a straw to be inserted coupled with a scored pie-shaped section that can be fully removed for drinking.

When the above and other objects in view, the present invention consists of the combination and arrangement of parts hereinafer more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
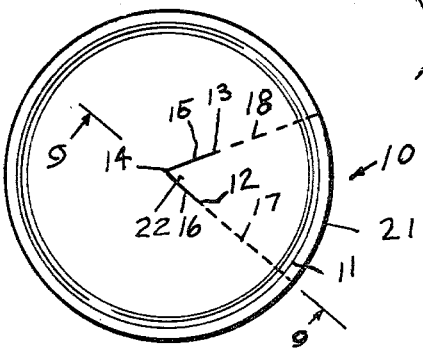
FIG. 1 is a top view of a lid according to the invention.
Figure 4:
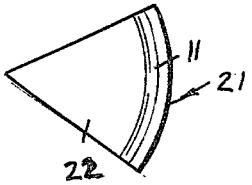
FIG. 4 is the view showing the tab removed from the lid shown in FIG. 3.
Figure 3:
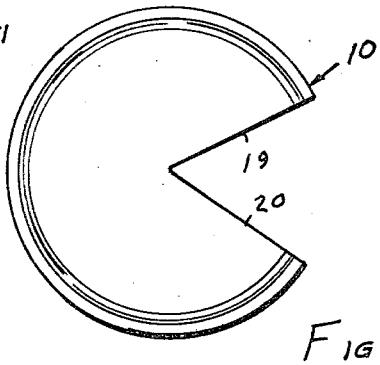
FIG. 3 is a top view of the embodiment of FIG. 1 showing the tab removed.

Now, with more particular reference to the drawings, and particularly the embodiment shown in FIGS. 1, 3, and 4 we show a lid 10 for a cup having a groove 11 extending around the periphery to be fitted over the rim of the cup. The lid 10 additionally includes a pair of radially extending scored lines 12 and 13 that converge toward each other and towards the center of the lid 14. The line segments 15 and 16 adjacent to center 14 are cut completely through the material of the lid so that the tab portion 22 can be forced inwardly or upwardly back to the points 12 and 13. The line segments 15 and 16 are cut so that when the user desires to remove the pie-shaped piece 22 can be grasp and lift it out, tearing it along scored lines 17 and 18.

In the event that the operator wishes to drink the material from the cup with a straw he merely presses down on the area 22 with the end of the straw, bending the section 22 downward and allowing the straw to enter and the remainder of the section to remain intact.

Figure 5:
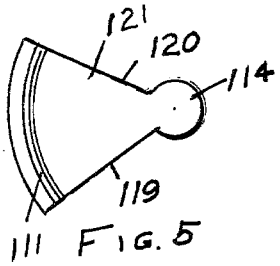
FIG. 5 is a view showing the tab removed from the lid shown in FIG. 2.
Figure 9:
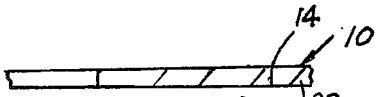
FIG. 9 is an enlarged partial cross-section view taken on Line 9—9 of FIG. 1.
Figure 10:
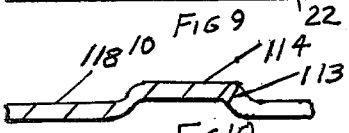
FIG. 10 is an enlarged partial cross-sectional view taken on Line 10—10 of FIG. 2.
Figure 2:
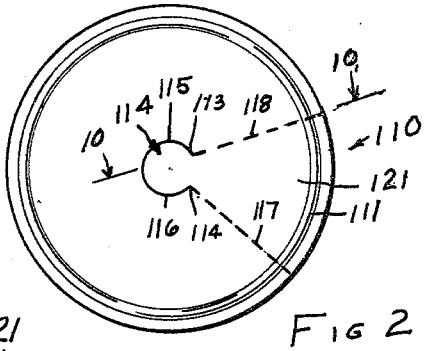
FIG. 2 is a view similar to FIG. 1 of another embodiment of the invention.

In the embodiment of the invention shown in FIGS. 2 and 5 a lid 110 is indicated having a groove 111 formed in it to be fitted over the rim of a cup. The lid has two scored line segments 117 and 118 that terminate adjacent the center of the lid in the circular portion 114 that extends around the circle indicated at 115 and 116. The lines 115 and 116 are cut through. The segments 117 and 118 are scored up to the points 113 and 114 so that the operator can grasp the circular portion 114 and lift the pie-shaped section 121 from the lid providing an opening through which the user can drink the contents of the cup. The circular section 114 can also be pushed downward for a straw.

Scored line segments 117 and 118 so weaken the material that it can easily be torn to remove the pie-shaped piece 114 from the lid leaving an opening defined by edges 119 and 120.

Figure 6:
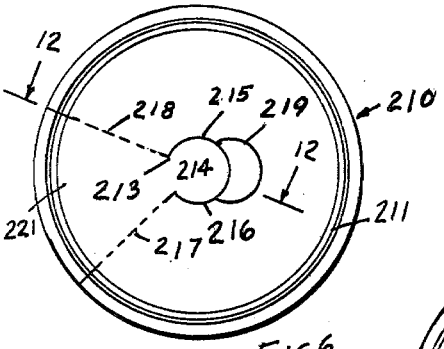
FIG. 6 is a view of another embodiment of the invention.
Figure 12:
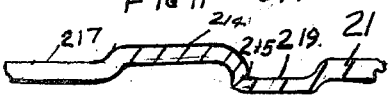
FIG. 12 is an enlarged partial cross-sectional view taken on Line 12—12 of FIG. 6.

In the embodiment of the invention shown in FIGS. 6 and 12 the lid indicated at 210 has a groove 211 extending around adjacent its periphery to be fitted over the rim of the cup. Any other suitable attaching means can be provided for supporting the lid on the cup. The lid 210 includes a pair of radially extending scored lines 217 and 218 that converge towards each other and towards the center of the lid at 214. The line segments 215 and 216 adjacent the center tab 214 are cut completely through around the center tab portion 214 so that the tab portion 214 can be forced upward. An embossed section 219 provides a recess into which a person can put his fingernail or fingertip to slide under the end of the tab 214 which is embossed upward to ease grasping. The line segments 217 and 218 are scored so that when the user desires to remove the pie-shaped section 221, he can, in one motion, grasp the tab 214 by depressing his fingernail or fingertip on section 219 and slide same upward across line segments 215 and 216 to graps tab 214 and remove the pie-shaped piece 221 upwardly and outwardly.

Figure 7:
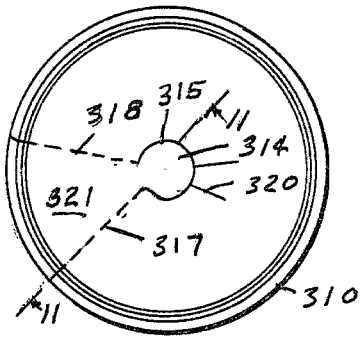
FIG. 7 is a view of another embodiment of the invention.
Figure 11:
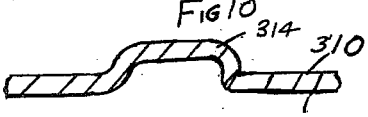
FIG. 11 is an enlarged partial cross-sectional view taken on Line 11—11 of FIG. 7.

In the embodiment of the invention shown in FIGS. 7 and 11 a lid is shown indicated at 310 having a section 321 that is defined by lines 317 and 318 which intersect at the central section 314. The central tab portion 314 is completely cut through and around it at 315 and the tab portion 314 is embossed outwardly so that the user can easily press on the recess defined by slits 311 and 320 and slide his fingernail or fingertip upwardly across line 315 to grasp tab 314 and remove uwardly and outwardly the pie-shaped piece 321.

Figure 13:
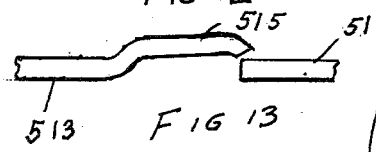
FIG. 13 is an enlarged partial cross-sectional view taken on Line 13—13 of FIG. 8.

The embodiment of the invention shown in FIG. 13 is similar to FIG. 1 but the central tab part 514 is made to project upwardly from the remainder of the lid so that a person can easily engage with his fingernail or fingertip the end of the tab 515 to lift the pie-shaped piece 21 upwardly and outwardly from the lid.

Figure 8:
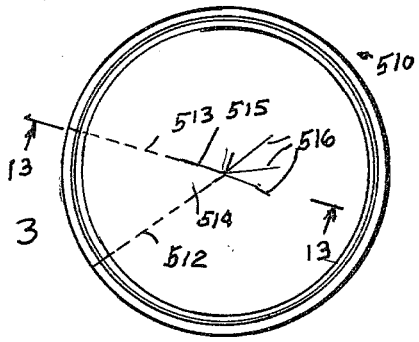
FIG. 8 is a view of another embodiment of the invention.

In the embodiment of the invention shown in FIG. 8 the material of the lid 510 is scored along lines 513 and 514 and cut along lines 515 and 516 so that the user can press inwardly on the cuts adjacent to the tip of the pie-shaped piece at 517 and catch the tip 517 with his fingernail or fingertip to grasp and lift the pie-shaped piece upwardly and outwardly from the cup.

In all embodiments of the invention, the completely scored and/or partially scored tabs and slits also provide a pressure release and openings for straws. In all embodiments the scored and/or partially scored lines provide the opportunity to remove the pie-shaped piece from the outer edge of the lid lifting upwardly and tearing toward the center of the lid. A tab and/or cuts can be added to the outer rim of the lid to ease and facilitate this removal method.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or priviledge is claimed are defined as follows:

1. A drinking cup lid that can be fitted over the rim of a drinking cup comprising, a circular shaped lid, means on said lid to attach said lid to a container, a pair of generally radially extending scored lines starting in scored first segments at the peripheral edge of the lid and extending inwardly and converging toward each other, defining generally a pie-shaped piece and terminating adjacent the center of said lid in a second line defining an arc of a circle said second segment being completely cut through said lid connecting said lines together, said segment at the center of the lid providing a part of said pie-shaped piece adapted to be pressed inwardly by a drinking straw, said lines defining a pie-shaped piece of the lid defined by the scored segments and cut through segments being adapted to be removed by tearing along the scored lines providing a relatively large opening for drinking, said scored line segments and said cut through line segments comprise one continuous line, said cut through lines defining a circular outwardly extending section 215 adapted to be deflected inwardly by a drinking straw, said cut through section 215 extending outwardly from said lid then inwardly to said lid providing access for a user's finger nail thereunder, an inwardly extending section adjacent said outwardly extending section, said inwardly extending section terminating at the top surface of said lid, providing an efficient position for the finger nail of a person to lift said outwardly extending section whereby the finger nail of a person can be inserted under said cut through section and said outwardly extending section can be lifted by said person to remove said pie shaped piece.

* * * * *